US007230635B2

(12) United States Patent
Kawamoto

(10) Patent No.: US 7,230,635 B2
(45) Date of Patent: Jun. 12, 2007

(54) PRINTER

(75) Inventor: Yusaku Kawamoto, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 226 days.

(21) Appl. No.: 11/151,238

(22) Filed: Jun. 14, 2005

(65) Prior Publication Data

US 2005/0280691 A1 Dec. 22, 2005

(30) Foreign Application Priority Data

Jun. 16, 2004 (JP) ..... 2004-178885

(51) Int. Cl.
*B41J 2/32* (2006.01)

(52) U.S. Cl. ..... 347/171; 347/218

(58) Field of Classification Search ..... 347/171, 347/172, 175, 215, 218; 400/120.01, 120.03, 400/621

See application file for complete search history.

(56) References Cited

U.S. PATENT DOCUMENTS 7,084,891 B2 * 8/2006 Ueda ..... 347/175

FOREIGN PATENT DOCUMENTS

JP 2002-086816 3/2002
JP 2003-174553 6/2003

* cited by examiner

*Primary Examiner*—Huan Tran
(74) *Attorney, Agent, or Firm*—Crowell & Moring LLP

(57) ABSTRACT

In a printer that forms an image on a color thermal recording paper by using a thermal recording head, a preheating region of the recording paper that is used for preheating the thermal recording head in a process prior to formation of the image and disposed of as a cut piece can effectively be used. An image forming control unit preheats a part of the thermal recording head in each end region that contact with the recording paper for heating the thermal recording heat to a proper temperature just before forming an image on the recording paper. While preheating of the thermal recording head, the image forming control unit further controls the thermal recording head for printing arbitrary information such as residual quantity of the recording paper on a portion between preheated portions of the recording paper to be disposed as the cut sheet.

5 Claims, 5 Drawing Sheets

PRINTER

BACKGROUND OF THE INVENTION

1. Field of the Invention

The present invention relates to a printer using a recording paper roll formed of long recording paper wound around a core, particularly, a printer that prints image data taken by a digital camera.

2. Description of the Related Art

In recent years, with the spread of digital cameras, a printer that can print an image by directly connecting to the digital camera or inserting a memory card thereto without using a personal computer has been put to practical use. To distinguish from a conventional printer to be connected to the personal computer, such a printer is referred to as "a digital camera-enabled printer".

In the digital camera-enabled printer, thermal recording paper is adopted to obtain substantially the same print quality as a film photo using a conventional film and photographic paper. Since the size of the image to be printed is subject to the film photo system, it is required to correspond to the aspect ratio of general imaging devices and especially, an oblong print such as panoramic print. Thus, generally, the digital camera-enabled printer supports various sizes of images by using a recording paper roll formed of long recording paper wound around a cylindrical core, fixing the size of one of vertical and horizontal sides of the image to be printed to the width of the recording paper and changing the length of recording paper to be cut according to the size of the other side.

In the above-mentioned digital camera-enabled printer using the thermal recording paper, an image is formed on a sheet of recording paper with using a thermal recording head. In the printer having the thermal recording head, to make coloring of the image properly, it is necessary to preheat the thermal recording head to a proper temperature prior to the formation of the image. While the preheating of the thermal recording head, the recording paper is placed between a platen roller and the thermal recording head so as not to deteriorate the thermal recording head. When the thermal recording head is preheated with the recording paper being contacted with the thermal recording head in this manner, the contact portion of the recording paper is heated and coloring occurs at the heated portion, and thus becomes useless for the print of the image.

Then, in the conventional digital camera-enabled printer, the heated portion heated in which coloring occurs during preheating of the recording head is cut after the formation of an image desired by a user on the recording paper. The cut piece is fractionally removed from the paper sheet on which the image is formed. The cut pieces thus generated are generally disposed of and cannot be used effectively.

In a conventional printer, for example, shown in Japanese Laid-Open Patent Publication No. 2003-174553, an advertisement data is combined with an original image data and the combined image data is used for forming an image with an advertisement on a paper sheet. In another conventional printer, for example, shown in Japanese Laid-Open Patent Publication No. 2002-86816, an advertisement is variously printed on a paper sheet corresponding to time-zone or a day of the week.

SUMMARY OF THE INVENTION

To solve the above-mentioned problem, the present invention is objected to provide a printer that allows the cut piece caused by preheating of the thermal recording head corresponding to the thermal recording paper to be used effectively.

A printer in accordance with an aspect of the present invention comprises: a recording paper conveying mechanism for conveying a long thermal recording paper in a sub-scanning direction perpendicular to a longitudinal direction of the thermal recording paper fed from a recording paper roll formed of the thermal recording paper wound around a cylindrical core; a thermal recording head provided at a downstream side from the recording paper roll in the sub-scanning direction for forming an image on the thermal recording paper on line-by-line in a main-scanning direction parallel to a width direction of the thermal recording paper; a cutter provided at the downstream side from the thermal recording head for cutting a portion of the thermal recording paper on which the image is formed according to a size of the image; an image data reading unit for reading digital image data from a digital camera or a memory card; an image forming control unit for controlling driving of the thermal recording head with using an image data read from the image data reading unit; a conveyance control unit for controlling driving of the recording paper conveying mechanism with using image data read from the image data reading unit; and a cutting control unit for controlling driving of the cutter with using the image data read from the image data reading unit.

The image forming control unit makes the thermal recording head to be preheated to a proper temperature just before forming an image on the thermal recording paper, while making the thermal recording head into contact with a predetermined region of the thermal recording paper. The cutting control unit drives the cutter for cutting a first portion of the thermal recording paper that is heated during preheating of the thermal recording head and also cutting a second portion of the thermal recording paper on which the image is formed after forming the image on the thermal recording paper, and discharges cut portions to outside.

The image forming control unit further controls the thermal recording head so as to print an arbitrary information in the first portion while the thermal recording head is preheated.

By such a configuration, since various information can be printed on the cut piece caused by the preheating of the thermal recording head, the cut piece that has been conventionally disposed of as it was can be used effectively to offer significant information to the user.

It is possible that the thermal recording head has an array of minute heat generating devices, and only a part of the array of minute heat generating devices in each end region in contact with the color thermal recording paper is preheated.

By such a configuration, heat generated by preheating of the arrays of the minute heat generating devices in both end regions of the thermal recording head is conducted to an inner region disposed between the arrays of the minute heat generating devices. Thus, it is possible to save electricity necessary for preheating of the thermal recording head.

Furthermore, non-colored portion can be formed on the cut piece due to the thermal recording head is not preheated over the full width of the portion that comes in contact with the color thermal recording paper.

It is possible that the image forming control unit controls the thermal recording head so as to print the arbitrary information in a portion of the first portion where the color thermal recording paper is not colored by heat due to preheating of the thermal recording head.

By such a configuration, the arbitrary information can be printed on the non-colored portion of the cut sheet, so that visibility of the arbitrary information can be increased.

Still furthermore, it is possible that the conveyance control unit presumes the residual quantity of the recording paper roll and calculates a number of printable remaining sheets; and the image forming control unit controls the thermal recording head so as to print a number of printable remaining sheets as the arbitrary information in the first portion.

By such a configuration, it becomes quite obvious how many sheets are further printable, and therefore, the user can prepare a new recording paper roll well in advance.

DETAILED DESCRIPTION OF THE EMBODIMENTS

Figure 1:
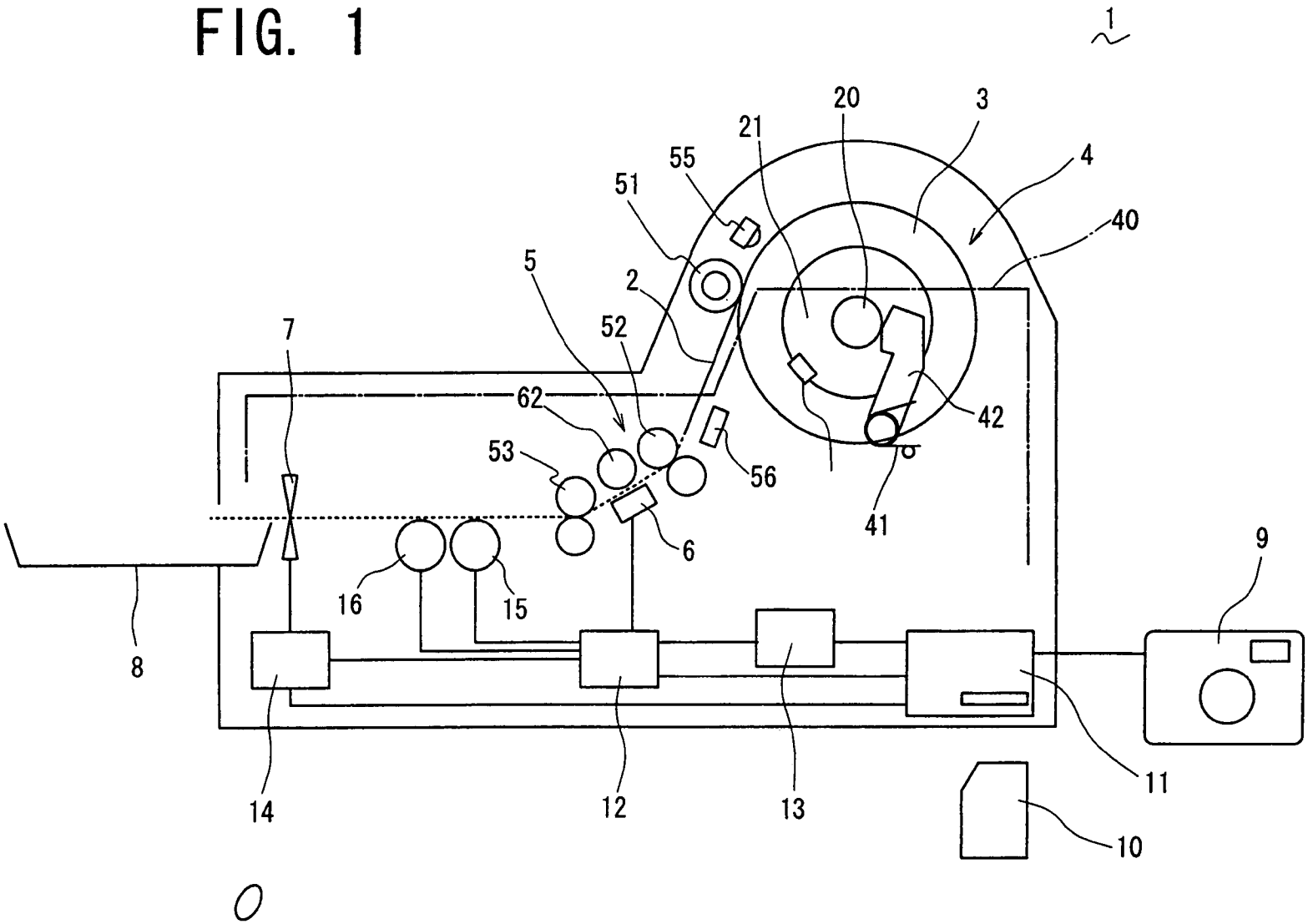
FIG. 1 is a sectional side view showing a configuration of a printer in accordance with an embodiment of the present invention.

A preferred embodiment of the present invention is described with reference to figures. FIG. 1 shows a schematic configuration of a printer 1 that drives a thermal recording head for forming an image on a color thermal recording paper by using digital image data.

As shown in FIG. 1, the printer 1 comprises a paper feeding unit 4 for containing a recording paper roll 3 formed of long color thermal recording paper 2 wound around a core 21, a recording paper conveying mechanism 5 for pulling out a front end of the color thermal recording paper 2 from the recording paper roll 3 and conveying the color thermal recording paper 2 in the longitudinal direction thereof (hereinafter referred to as the conveying direction), a thermal recording head 6 provided at the downstream side from the recording paper roll 3 in the conveying direction for forming an image on the color thermal recording paper 2, a first ultraviolet lamp 15 and a second ultraviolet lamp 16 each for radiating a ultraviolet lay with a predetermined wavelength on an image forming surface of the color thermal recording paper 2, a cutter 7 for cutting a portion of the color thermal recording paper 2 on which the image is formed and so on, and a tray 8 for holding a piece of recording paper cut by the cutter 7, that is, the print on which the image is formed.

The printer 1 further comprises an image data reading unit 11 to which a digital camera 9 is directly connected or a memory card is inserted, thereby reading digital image data therefrom, an image forming control unit 12 for driving the thermal recording head 6 and the first and second ultraviolet lamps 15 and 16 by using the image data read from the image data reading unit 11, a recording paper conveyance control unit 13 for driving the recording paper conveying mechanism 5 by using the image data read from the image data reading unit 11 and a recording paper cutting control unit 14 for driving the cutter 7 by using the image data read from the image data reading unit 11.

A pair of axial units 20 is engaged with both ends of the core 21 of recording paper roll 3, respectively, and rotatably supported on a frame 40. The diameter of the recording paper roll 3 becomes gradually smaller as the color thermal recording paper 2 is consumed. Thus, the axial units 20 pivoting rotation of the recording paper roll 3 are not driven in themselves, but configured so as to rotate following conveyance of the color thermal recording paper 2 by the recording paper conveying mechanism 5.

The recording paper conveying mechanism 5 is comprised of a feeding roller 51 contacting with an outer periphery of the recording paper roll 3 with a pressure for sending out or pulling back the color thermal recording paper 2 in the conveying direction by rotationally driven in the predetermined direction, driving rollers 52 and 53 for reciprocally conveying a portion in the vicinity of a front end of the color thermal recording paper 2 pulled out from the recording paper roll 3 in the conveying direction at a constant speed, and a motor (not shown) for rotationally driving these rollers 51, 52 and 53. The driving roller 52 is arranged at the upstream side from the thermal recording head 6 and the driving roller 53 is arranged at the downstream side from the thermal recording head 6. The above-mentioned axial units 20 are pressed by a torsion spring 41, a pressing lever 42 and the like in a direction to press the outer peripheral surface of the recording paper roll 3 against the feeding roller 51.

The thermal recording head 6 has a array of minute heat generating devices arranged in the direction perpendicularly to the conveying direction, and controls heat generation and non-heat generation of the minute heat generating portions with using digital image data so as to form an image on a line-by-line basis on the image forming surface of the color thermal recording paper 2.

The first and second ultraviolet lamps 15 and 16 radiate ultraviolet lays each having a first wavelength and a second wavelength on the image forming surface of the color thermal recording paper 2 and fixes an Y-layer that reacts to the ultraviolet ray with the first wavelength and an M-layer that reacts to the ultraviolet ray with the second wavelength so as not to develop a color any more.

A terminal neighboring sensor 55 for detecting a terminal neighboring mark formed in the neighborhood of a terminal of the color thermal recording paper 2 is provided at the neighborhood of the outer periphery of the recording paper roll 3. Furthermore, a front end sensor 56 for detecting the front end of the color thermal recording paper 2 is provided at the position that is located upstream side of the driving roller 52 and neighbored to a conveying path of the color thermal recording paper 2. Still furthermore, a pattern sensor (core information reading means) 57 for reading pattern information formed on an end face of the core 21 is provided at a position opposing to the end face of the core 21 of the loaded recording paper roll 3.

Subsequently, printing operation by the printer 1 will be described. When an image data is read by the image data reading unit 11, the image forming control unit 12 determines a size of the image to be printed on the basis of the read image data. In the printer 1, since the width of the color thermal recording paper 2 is fixed, magnifying power is calculated in order to substantially match a short side of the image with the width of the color thermal recording paper 2. The image size of the color thermal recording paper 2 in the conveying direction is calculated based on the calculated magnifying power and the ratio of a long side to the short side of the image.

When the image size is calculated, the recording paper conveyance control unit 13 drives the recording paper conveying mechanism 5 according to the size of the recording paper and sends out the color thermal recording paper 2 to the downstream side in the conveying direction by a predetermined length according to the image size. The image forming control unit 12 applies a predetermined driving voltage to the thermal recording head 6 in the state where the color thermal recording paper 2 is interleaved between the thermal recording head 6 and a platen roller 62 to preheat the thermal recording head 6.

Figure 2:
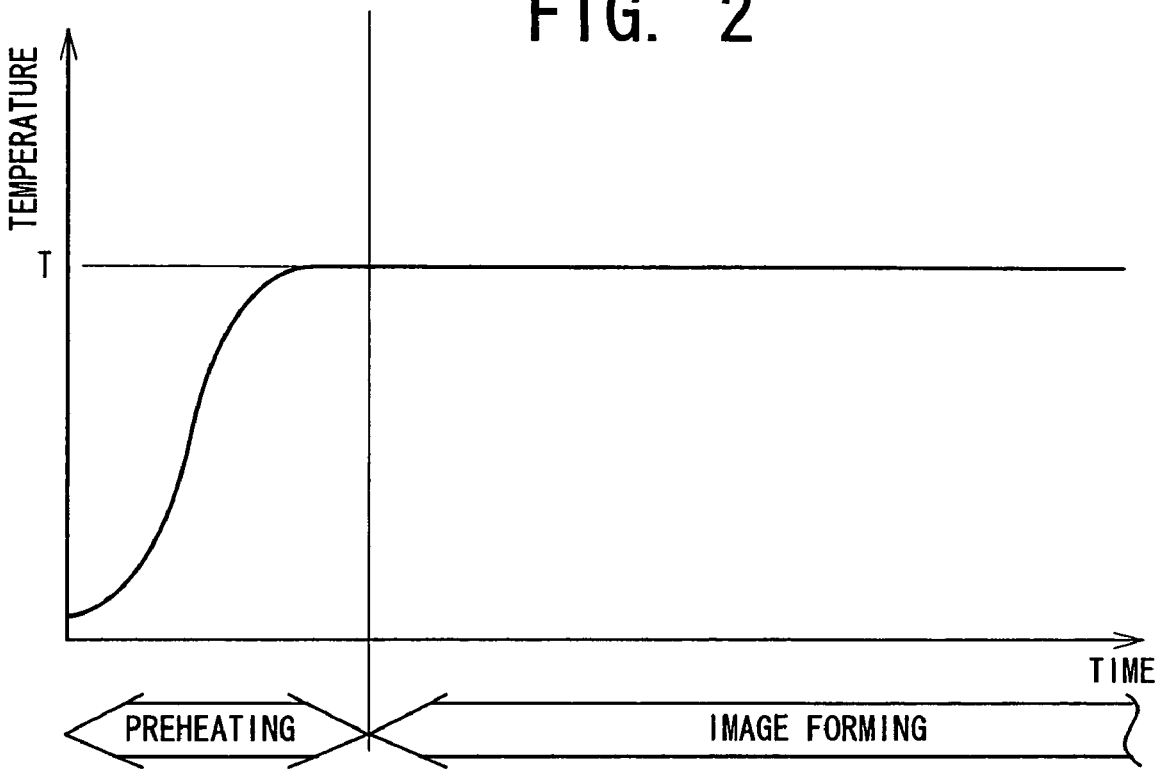
FIG. 2 is a time chart showing temperature change of a thermal recording head from preheating to image formation in the above-mentioned printer.

FIG. 2 shows a relationship between preheating time and temperature of the thermal recording head 6. Before forming the image, the image forming control unit 12 preheats the thermal recording head 6 to a temperature T necessary for coloring the color thermal recording paper 2 normally by applying a driving voltage to the thermal recording head 6 for a predetermined time. When the preheating of the thermal recording head 6 is completed, the recording paper conveyance control unit 13 drives the recording paper conveying mechanism 5 for conveying the color thermal recording paper 2 from an initial position to the side of the thermal recording head 6 toward the upstream side in the conveying direction at a constant speed. In parallel with this, the image forming control unit 12 forms an image of yellow on an yellow layer (Y-layer) of the color thermal recording paper 2 by driving thermal recording head 6 in a first temperature range with using an image data of yellow (Y) among the read image data.

When the image of yellow is formed on the Y-layer of the color thermal recording paper 2, the recording paper conveyance control unit 13 drives the recording paper conveying mechanism 5 so as to temporarily return the color thermal recording paper 2 to the initial position at the downstream side in the conveying direction, and conveys the color thermal recording paper 2 to the upstream side of the conveying direction again. In parallel to this, the image forming control unit 12 drives the first ultraviolet lamp 15, thereby radiating the ultraviolet ray having the first wavelength on the image forming surface of the color thermal recording paper 2 so as to fix the Y-layer.

When fixation of the Y-layer of the color thermal recording paper 2 is completed, the image forming control unit 12 preheats the thermal recording head 6 at a higher driving voltage than that in forming the image of yellow. Thereby, the thermal recording head 6 is preheated to a second temperature range for forming an image of magenta (M), which is higher than the first temperature range. When preheating of the thermal recording head 6 for forming the image of magenta (M) is completed, the recording paper conveyance control unit 13 drives the recording paper conveying mechanism 5 so as to convey the color thermal recording paper 2 from the initial position to the side of the thermal recording head 6 at a constant speed. In parallel with this, the image forming control unit 12 forms an image of magenta on a magenta layer (M-layer) of the color thermal recording paper 2 by driving the thermal recording head 6 in the second temperature range with using an image data of magenta among the read image data.

When the image of magenta is formed on the M-layer of the color thermal recording paper 2, the recording paper conveyance control unit 13 drives the recording paper conveying mechanism 5 so as to temporarily return the color thermal recording paper 2 to the initial position at the downstream side in the conveying direction, and conveys the color thermal recording paper 2 to the upstream side in the conveying direction again. In parallel to this, the image forming control unit 12 drives the second ultraviolet lamp 16, thereby radiating the ultraviolet ray having the second wavelength on the image forming surface of the color thermal recording paper 2 so as to fix the M-layer.

When fixation of the M-layer of the color thermal recording paper 2 is completed, the image forming control unit 12 preheats the thermal recording head 6 at a higher driving voltage than that in forming the image of magenta. Thereby, the thermal recording head 6 is preheated to a third temperature range for forming an image of cyan (C), which is higher than the second temperature range. When preheating of the thermal recording head 6 for forming the image of cyan (C) is completed, the image forming control unit 12 forms an image of cyan on a cyan layer (C-layer) of the color thermal recording paper 2 by driving the thermal recording head 6 in the third temperature range with using an image data of cyan among the read image data.

However, since the portion of the color thermal recording paper 2, which is in contact with the thermal recording head 6 during preheating of the thermal recording head 6, is heated and colored with preheating of thermal recording head 6, the portion cannot be available for image information. Since the printer 1 of this embodiment is configured so as to preheat the thermal recording head 6 just before forming an image, an image formed region in which the image is formed and a preheated region used for preheating are formed alternately on the image forming surface of the color thermal recording paper 2.

Figure 3:
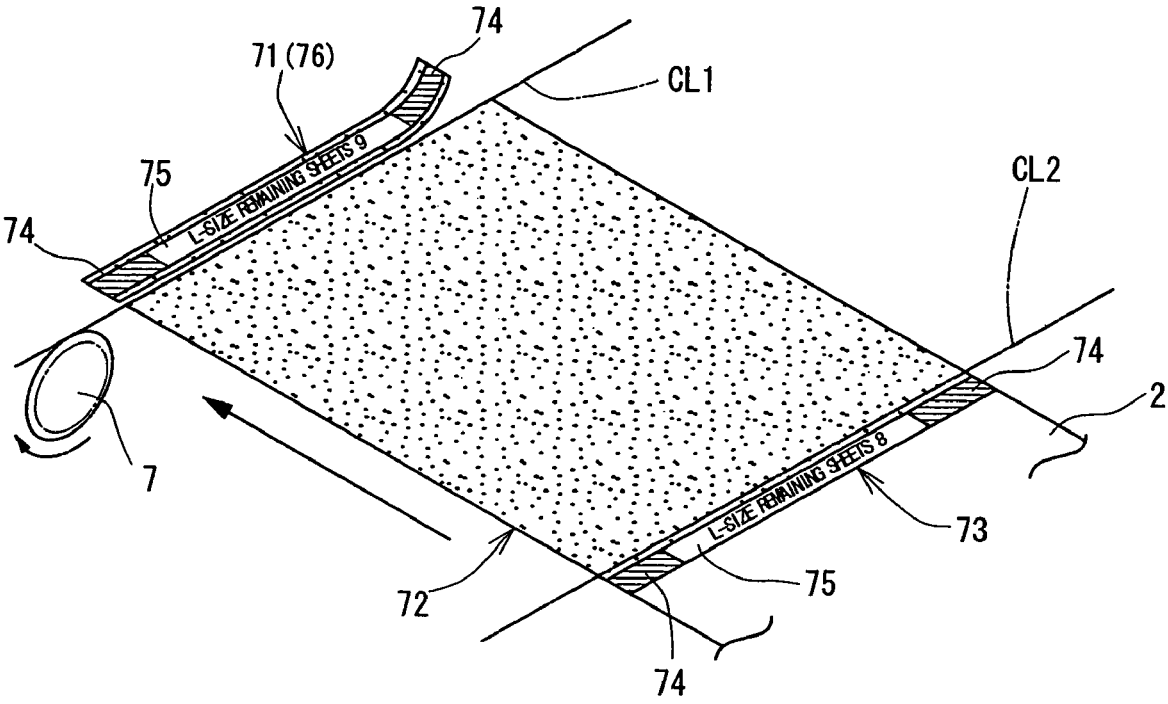
FIG. 3 is a perspective view showing preheating regions and an image forming region that are formed on a color thermal recording paper by the above-mentioned printer.

FIG. 3 shows the image recording surface of the color thermal recording paper 2 on which the image formed region and the preheated region are formed alternately. A preheated region 71 used in a previous printing process is formed at the front end of the color thermal recording paper 2, and an image formed region 72 and a preheated region 73 that are used in this printing process are formed serially with the preheated region 71.

Figure 4:
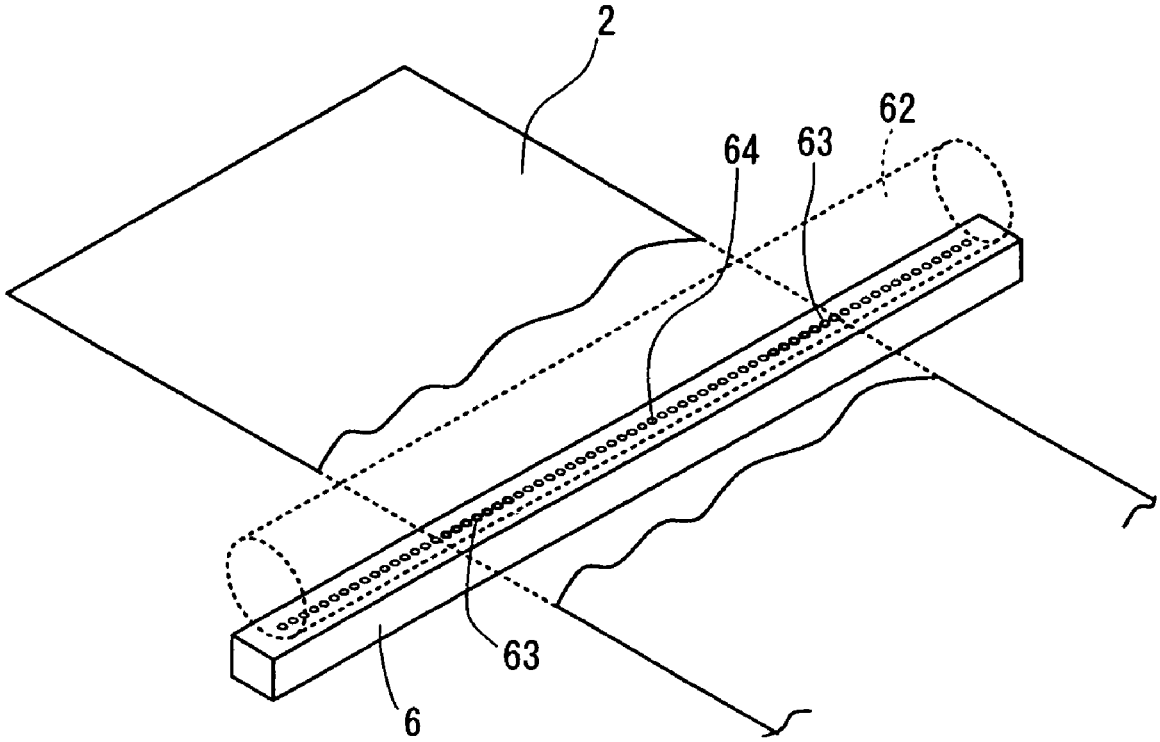
FIG. 4 is a perspective view showing a state where the thermal recording head of the above-mentioned printer is preheated.

As shown in FIG. 4, the thermal recording head 6 is not preheated over the full width of the portion that comes in contact with the color thermal recording paper 2, and only array 63 of the minute heat generating devices in each end region is heated through the application of a preheating voltage. Since the heat generated by preheating of the arrays 63 of the minute heat generating devices in both end regions of the thermal recording head 6 is conducted to an inner region disposed between the arrays 63 of the minute heat generating devices, the preheating voltage is not applied to an array in the inner region. Therefore, as shown in FIG. 3, in the preheated regions 71 and 73 of the color thermal recording paper 2, respectively, a colored region 74 colored by preheating is formed at their each end and a non-colored region 75 is formed between the colored regions 74.

In this embodiment, arbitrary information is printed in the non-colored region 75 during preheating of the thermal recording head 6. In FIG. 3, the size and the number of remaining sheets of the recording paper roll 3 are printed as an example of information printed in the non-colored region 75. The number of remaining sheets is calculated by a calculation procedure described later.

When the formation of the image by the thermal recording head 6 is completed, the color thermal recording paper 2 is conveyed to the downstream side in the conveying direction and cut by the cutter 7. Whereby, the preheated region 71 (cut piece 76) and the image formed region 72 are cut and separated from the color thermal recording paper 2. At this time, the cutter 7 cuts the color thermal recording paper 2 along cutting lines CL1 and CL2 assumed to be located slightly inner from boundaries between the image formed region and the preheated regions 71 and 73, respectively (at the side of the image forming region 72). The preheated region 73 is cut from the color thermal recording paper 2 in a next printing process.

The information printed on the non-colored region 75 of the preheating region 71 cut as the cut piece 76 is not limited to the size and the number of remaining sheets of the recording paper roll 3, and may be a predetermined advertisement, for example. In such a case, if a supplier of the recording paper roll 3 concludes a contract that collects advertising charges from an advertiser, the price of the recording paper roll 3 can be lowered by the advertising charges. The information about advertisement can be formed in the core 21 of the recording paper roll 3, for example.

Figure 5:
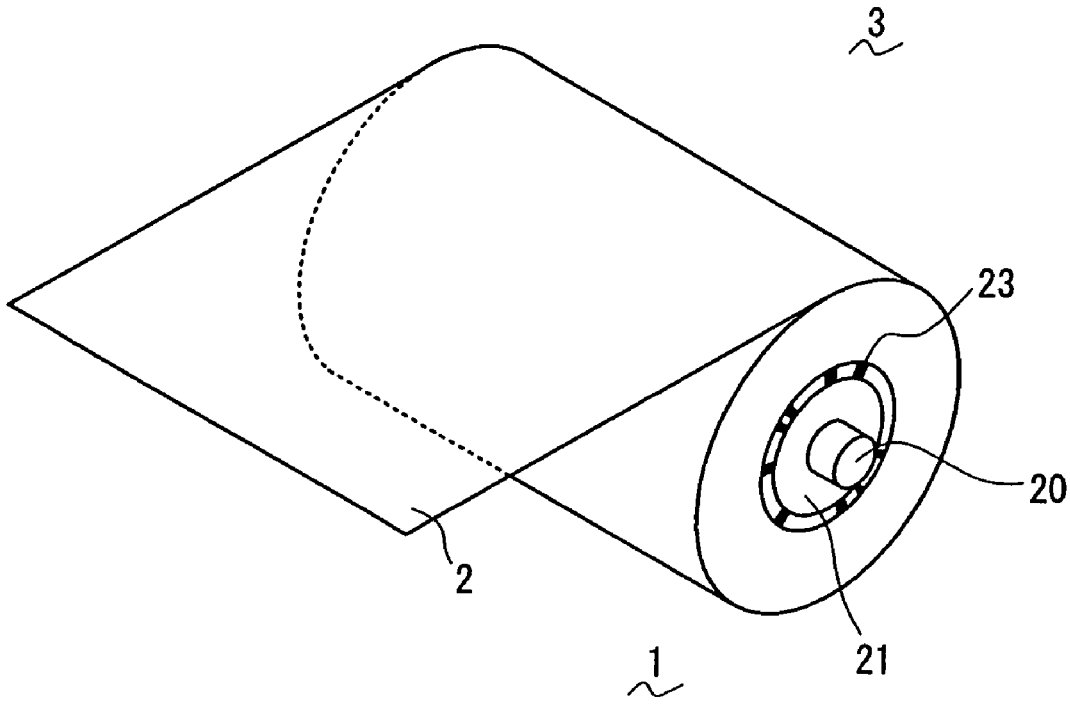
FIG. 5 is a perspective view showing a configuration of a recording paper roll used in the above-mentioned printer.

FIG. 5 shows the recording paper roll 3 with the information about advertisement formed on the core 21. A pattern 23 in which the information about advertisement is coded is formed in the vicinity of the outer periphery of the end face of the core 21. The pattern sensor (core information reading means) 57 is formed in the position that can be opposed to the end face of the core 21 of the loaded recording paper roll 3. The pattern sensor 57 radiates light on the end face of the core 21 under rotation, receives the reflected light and converts the light into an electrical signal, thereby reading the pattern 23. The electrical signal converted by the pattern sensor 57 is transmitted to the image forming control unit 12, the recording paper conveyance control unit 13, and so on. The image forming control unit 12 receives and decodes the electrical signal transmitted from the pattern sensor 57, thereby converting the electrical signal into image data such as character information formed on the color thermal recording paper 2 by the thermal recording head 6.

Subsequently, a calculation procedure of the number of remaining sheets that can be printed on the recording paper roll 3 mentioned above will be described. First, the recording paper conveyance control unit 13 drives the recording paper conveying mechanism 5, thereby conveying the color thermal recording paper 2, and calculates rotational period of the recording paper roll 3 on the basis of the electric signal transmitted from the pattern sensor 57 at that time. Hereupon, while the rotational period of the feeding roller 51 depends on only conveying speed of the color thermal recording paper 2, not residual quantity of the recording paper roll 3, the rotational period of the recording paper roll 3 becomes shorter as the residual quantity of recording paper roll 3 decreases. Therefore, if the ratio of the rotation period of the recording paper roll 3 to the rotation period of the feeding roller 51 is calculated, it is possible to presume the residual quantity of the recording paper roll 3 substantially accurately and to calculate the number of printable remaining sheets.

As described above, according to the printer 1 of this embodiment, since various information is printed on the cut piece 76 caused by preheating of the thermal recording head 6, it is possible to offer significant information to the user by effectively using the cut piece that has been conventionally disposed of as it was. Furthermore, since the information read by the pattern sensor 57 can be printed on the cut piece 76, it is possible to reduce the price of the recording paper roll 3 by advertising charges, when the maker of the recording paper roll 3 forms various information such as advertisement on the end face of the core 21 of the recording paper roll 3. Still furthermore, since the residual quantity of recording paper roll 3 can be printed on the cut piece 76, it becomes quite obvious how many sheets are further printable, and therefore, the user can prepare a new recording paper roll 3 well in advance. In addition, since heat is conducted adequately from the portion that comes in contact with the predetermined region at both sides of the color thermal recording paper 2 toward the inner region, temperature distribution of the thermal recording head 6 becomes substantially uniform, and therefore an image with uniform color distribution can be obtained. Still furthermore, since the above-mentioned information is formed in the inner non-colored region 75 that is not heated by preheating of the thermal recording head 6, information can be printed clearly.

The present invention is not limited to the configuration of the above-mentioned embodiment and various modifications can be made. For example, the thermal recording head 6 may be preheated over the full width of the portion that comes in contact with the color thermal recording paper 2. In such a case, it is possible that the information be written by outline characters on the colored background. Still furthermore, since the information printed on the cut piece 76 colored during preheating is not limited to the number of remaining sheets of the recording paper roll 3 or advertisement, it is possible to print any information significant to the user including on the cut piece 76. A paper fortune can be mentioned as an example of such information. When the fortune is printed on the cut piece 76, the user can read and enjoy the fortune printed on the cut piece 76 each time when the image is printed.

This application is based on Japanese patent application 2004-178885 filed Jun. 16, 2004 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A printer comprising:

a recording paper conveying mechanism for conveying a long thermal recording paper in a sub-scanning direction perpendicular to a longitudinal direction of the thermal recording paper fed from a recording paper roll formed of the thermal recording paper wound around a cylindrical core;

a thermal recording head provided at a downstream side from the recording paper roll in the sub-scanning direction for forming an image on the thermal recording paper on line-by-line in a main-scanning direction parallel to a width direction of the thermal recording paper;

a cutter provided at the downstream side from the thermal recording head for cutting a portion of the thermal recording paper on which the image is formed according to a size of the image;

an image data reading unit for reading digital image data from a digital camera or a memory card;

an image forming control unit for controlling driving of the thermal recording head with using an image data read from the image data reading unit;

a conveyance control unit for controlling driving of the recording paper conveying mechanism with using image data read from the image data reading unit; and a cutting control unit for controlling driving of the cutter with using the image data read from the image data reading unit; and the image forming control unit making the thermal recording head to be preheated to a proper temperature just before forming an image on the thermal recording paper, while making the thermal recording head into contact with a predetermined region of the thermal recording paper;

the cutting control unit driving the cutter for cutting a first portion of the thermal recording paper that is heated during preheating of the thermal recording head and also cutting a second portion of the thermal recording paper on which the image is formed after forming the image on the thermal recording paper, and discharging cut portions to outside; and wherein the image forming control unit controls the thermal recording head so as to print an arbitrary information in the first portion while the thermal recording head is preheated.

2. The printer in accordance with claim 1, wherein the thermal recording head has an array of minute heat generating devices, and only a part of the array of minute heat generating devices in each end region in contact with the color thermal recording paper is preheated.

3. The printer in accordance with claim 2, wherein the image forming control unit controls the thermal recording head so as to print the arbitrary information in a portion of the first portion where the color thermal recording paper is not colored by heat due to preheating of the thermal recording head.

4. The printer in accordance with claim 1, wherein the conveyance control unit presumes the residual quantity of the recording paper roll and calculates a number of printable remaining sheets; and the image forming control unit controls the thermal recording head so as to print a number of printable remaining sheets as the arbitrary information in the first portion.

5. A printer comprising:

a recording paper conveying mechanism for conveying a long thermal recording paper in a sub-scanning direction perpendicular to a longitudinal direction of the thermal recording paper fed from a recording paper roll formed of the thermal recording paper wound around a cylindrical core;

a thermal recording head provided at a downstream side from the recording paper roll in the sub-scanning direction for forming an image on the thermal recording paper on line-by-line in a main-scanning direction parallel to a width direction of the thermal recording paper;

a cutter provided at the downstream side from the thermal recording head for cutting a portion of the thermal recording paper on which the image is formed according to a size of the image;

an image data reading means for reading digital image data from a digital camera or a memory card;

an image forming control means for controlling driving of the thermal recording head with using an image data read from the image data reading means;

a conveyance control means for controlling driving of the recording paper conveying mechanism with using image data read from the image data reading means; and a cutting control means for controlling driving of the cutter with using the image data read from the image data reading means;

the image forming control means making the thermal recording head to be preheated to a proper temperature just before forming an image on the thermal recording paper, while making the thermal recording head into contact with a predetermined region of the thermal recording paper;

the cutting control means driving the cutter for cutting a first portion of the thermal recording paper that is heated during preheating of the thermal recording head and also cutting a second portion of the thermal recording paper on which the image is formed after forming the image on the thermal recording paper, and discharging cut portions to outside; wherein a core information reading means for reading information formed on the end face of the core of the recording paper roll is further included, the core information reading means detects rotational period of the recording paper roll from the read information and calculates residual quantity of the thermal recording paper based on the detected rotational period;

the image forming control means preheats a part of the thermal recording head in each end region that comes into contact with the thermal recording paper during preheating in the main-scanning direction, and controls the thermal recording head so as to print information read by the core information reading means or information about the calculated residual quantity of the recording paper roll in an inner portion of the first region disposed between portions facing the preheated parts of the thermal recording head.

* * * * *